US006324773B1

(12) United States Patent
Gaither

(10) Patent No.: US 6,324,773 B1
(45) **Date of Patent: *Dec. 4, 2001**

(54) INTERNALLY LACED SHOE

(76) Inventor: David E. Gaither, 603 Willard Ave., SW., Atlanta, GA (US) 30310

( * ) Notice: Subject to any disclaimer, the term of this patent is extended or adjusted under 35 U.S.C. 154(b) by 0 days.

This patent is subject to a terminal disclaimer.

(21) Appl. No.: 09/374,153

(22) Filed: Aug. 13, 1999

Related U.S. Application Data

(63) Continuation-in-part of application No. 09/288,831, filed on Apr. 8, 1999.

(51) Int. Cl.[7] ..... A43C 11/00
(52) U.S. Cl. ..... 36/50.1; 36/58.5
(58) Field of Search ..... 36/50.1, 89, 92, 36/50.5, 58.5, 58.6

(56) References Cited

U.S. PATENT DOCUMENTS 3,793,749 * 2/1974 Gertsch et al. .
3,977,098 8/1976 Chalmers .
4,130,949 12/1978 Seidel .
4,571,856 2/1986 Lin et al. .
4,654,985 * 4/1987 Chalmers .
4,937,952 * 7/1990 Olivieri .
5,205,055 4/1993 Harrell .
5,269,078 12/1993 Cochrane .
5,400,529 3/1995 Bell et al. .
5,659,982 * 8/1997 Muraoka et al. .
5,687,460 11/1997 Foffano et al. .
5,775,006 7/1998 Breuner .
5,791,068 8/1998 Bernier et al. .
5,992,057 * 11/1999 Monit .

* cited by examiner

*Primary Examiner*—Ted Kavanaugh
(74) *Attorney, Agent, or Firm*—Joel D. Myers; Myers & Associates; Intellectual Property Law, P.C.

(57) ABSTRACT

An internal lacing system wherein a plurality of lace guides having rotatable rollers are strategically positioned throughout a shoe to facilitate the securing of the foot within the shoe. First and second elongated laces are internally channeled through the respective lace guides and then exit the internal of the shoe at the inner side of the shoe. One end of the first elongated lace is secured within the shoe proximal to the toe area, and the other end of the first elongated lace exits the internal of the shoe at lower inner side portion of the shoe proximal to the sole of the shoe. One end of the second elongated lace is secured within the shoe proximal to the exit location of the other end such that the second elongated lace wraps around the heel of the shoe and thus around the user's ankle. To tighten the shoe, a user simply pulls on the exposed second ends of the first and second laces thereby allowing the laces to roll along each respective roller positioned within each lace guide. Because the first ends of the first and second laces are fixed, the pulling on the second ends of the first and second laces will result in a reciprocating force about each lace guide thus securely tightening the shoe around the user's foot.

10 Claims, 3 Drawing Sheets

INTERNALLY LACED SHOE

CROSS-REFERENCE TO RELATED APPLICATIONS

This application is a continuation-in-part application of application Ser. No. 09/288,831 filed on Apr. 8, 1999 still pending.

BACKGROUND OF THE INVENTION

1. Technical Field

The present invention relates generally to footwear and, more specifically, to an internally laced shoe.

2. Background Art

There are a multitude of known designs for footwear and designs for lacing footwear. However, these known designs are deficient in light of the present invention. For instance, previous designs typically fail to adequately and comfortably secure a user's foot within the shoe.

Traditional shoes have an upper central exterior lacing system wherein the lacing is usually channeled through a plurality of eyelets positioned generally on both sides of the center top of the shoe and in close proximity thereto. This type of design fails to provide adequate support for the foot by limiting the securing area to generally the upper portion of the foot. For instance, in sporting applications, these traditional designs may be physically dangerous to the athlete and reduce the athlete's performance by allowing the foot to slide or otherwise move within the shoe during use. In addition, because the lacing in traditional designs are exterior, undesired accidents including snagging the lacing on objects and tripping on lacing that becomes untied during use may result. Moreover, because of the dangers of the exposed lacing of exterior-laced shoes becoming snagged on machinery and placing a user in dangerous positions, many companies forbid the use of these types of shoes in certain industrial applications. Additionally, the lacing of exterior-laced shoes is exposed to the shoes' exterior environment and often results in premature wear.

Several attempts have been made to overcome some of these deficiencies. For instance, designs have been proposed wherein the lacing system wraps around the heel portion of the shoe to provide a better means for securing the foot within the shoe. Examples of such designs may be found by reference to U.S. Pat. No. 5,775,006 to Breuner, U.S. Pat. No. 5,400,529 to Bell et al., U.S. Pat. No. 5,269,078 to Cochrane and U.S. Pat. No. 3,977,098 to Chalmers. However, these designs teach the use of heel lacing in boots and therein incorporate more complicated and/or bulky fastening means and, thus, are not suitable for typical shoes, especially sporting shoes. Moreover, lacing systems that only wrap around the heel of the shoe do not provide maximum securing of the entire foot within the shoe.

In an attempt to solve some of the above-discussed deficiencies of exterior lacing, U.S. Pat. No. 5,269,078 to Cochrane discloses a partially internally laced shoe. However, the internal lacing only wraps around the heel of the shoe; traditional lacing is needed for the upper center of the shoe. Nonetheless, even with the dual lacing system, Cochrane fails to secure the entire foot within a shoe as adequately as provided by the present invention. Moreover, the exterior lacing of Cochrane remains susceptible to snagging and premature wear and tear.

An additional deficiency noted in previous designs is the need to utilize two hands to tie and/or secure the lacing in position. For many handicap individuals, traditional shoes can be difficult if not impossible to tie and/or adequately secure around the feet. Additionally, many professional and nonprofessional athletes and other users find it both interfering and time consuming to use both hands to retie traditional shoe lacing that may become easily untied during use.

In an attempt to overcome these deficiencies, designs have been proposed that allow one hand or finger tightening. An example of such a design may be found by reference to U.S. Pat. No. 4,130,949 to Seidel. Although Seidel discloses a one-pull tightening system, as with other previous deficient designs, Seidel's lacing system only tightens the upper center portion of the shoe and thus fails to adequately secure the entire foot within the shoe.

It is readily apparent that a new and improved internally laced shoe is needed that provides for a lacing system that wraps around the entire shoe and foot, including the heel, to provide means for more adequately securing the entire foot within the shoe. The present invention overcomes the above-mentioned disadvantages by providing an internally laced shoe that more fully secures the wearer's foot within the shoe. It is, therefore, to the provision of such improvements that the present invention is directed.

BRIEF SUMMARY OF THE INVENTION

The present invention, in a preferred embodiment, comprises a shoe, a plurality of lace guides, a buckle, a first lace and a second lace. More specifically, lace guides are positioned at a multitude of advantage points to maximize the tightening of the shoe around a wearer's foot. These advantage points in the preferred embodiment are along the upper center, lower inside edge, lower outside edge and heel of the shoe. Preferably, one to eight lace guides are positioned along the lower inside edge above the sole, one to eight lace guides are positioned along the lower outside edge above the sole, two to eight lace guides are positioned along the upper center, and one to three lace guides are positioned on the heel of the shoe. Preferably, the first and second laces are generally elongated rectangular-shaped cloth, elastic or other flexible material each having a first end and a second end.

The first end of the first lace is sewn or otherwise secured internally near the toe of the shoe. The second end of the first lace is channeled through the lower inside and outside lace guides and preferably at least two of the upper center lace guides starting with the first lower edge lace guide proximal to the first end of the first lace and then through the first lace guide of the upper center set. Next, the second end of the first lace is channeled through the next adjacent bottom edge guide on the side of the shoe having the secured first end of the first lace. This pattern is continued until the lace is channeled through the next to last upper center lace guide, at which time the first lace exits the interior of the shoe and is channeled and secured through a fixed buckle or by hook-and-loop fastener and into a small slit positioned near the buckle to provide a means for hiding any excess lace.

The first end of the second lace is secured within the shoe proximal to the heel of the shoe. The second end of the second lace is then wrapped around the heel of the shoe, through the heel lace guide, and back around through the last upper center lace guide. Upon exiting this last lace guide the second end of the second lace is channeled and secured through a fixed buckle or by hook-and-loop fastener and into a small slit positioned near the buckle to provide a means for hiding any excess lace.

Alternatively or additionally, hook-and-loop fastener or other suitable securing means may be utilized to secure the first and second laces in the desired position in lieu of the buckles. Preferably, the upper center lace guides extend through apertures formed in the outside layer of the shoe and thus are the only externally visible lace guides. As such, the first and second laces remain internal until they exit out of the shoe at their respective locations except for small portions that are externally visible near or at the upper center lace guides.

Because of the strategically placed lace guides, a user simply pulls on the exposed second ends of the first and second laces thereby allowing the first and second laces to roll along a roller positioned within each lace guide. Additionally, because the first ends of the first and second laces are fixed, the pulling on the second ends of the first and second laces will result in a reciprocating force about each lace guide thus securely tightening the shoe around the user's foot.

The present invention has many features and advantages, some of which are listed herein and are as follows. A new and improved internal lacing system that is channeled through a multitude of lace guides strategically positioned to more securely tighten a shoe around a user's foot. A new and improved internal lacing system that is channeled internally through the shoe around the foot and heel to provide a complete wrap-around securing means for securing the shoe around a user's foot. A new and improved internal lacing system that allows for an easy means of tightening. A new and improved internal lacing system wherein the lace is substantially internal to protect the lace from wear and tear and thus reducing or eliminating the need for replacement lacing. A new and improved internal lacing system wherein the lace is substantially internal to reduce the risks of unintentional snagging of the lace. A new and improved internal lacing system wherein the lace is substantially internal to enhance the exterior aesthetics of a shoe. A new and improved internally laced shoe that is lightweight and relatively inexpensive to manufacture. A new and improved internal lacing system comprising lace guides having a roller to facilitating the movement of the lace. A new and improved internally laced shoe wherein the lace is substantially internal to provide more exterior surface, as compared to traditional shoe designs, for aesthetic designs and/or added upper center support. A new and improved internal lacing system wherein the lace has an elongated rectangular shape and is wider than traditional shoe lacing to better secure a user's foot within the shoe.

These and other objects, features and advantages of the invention will become more apparent to one skilled in the art from the following description and claims when read in light of the accompanying drawings.

DETAILED DESCRIPTION OF THE PREFERRED EMBODIMENT

Figure 1:
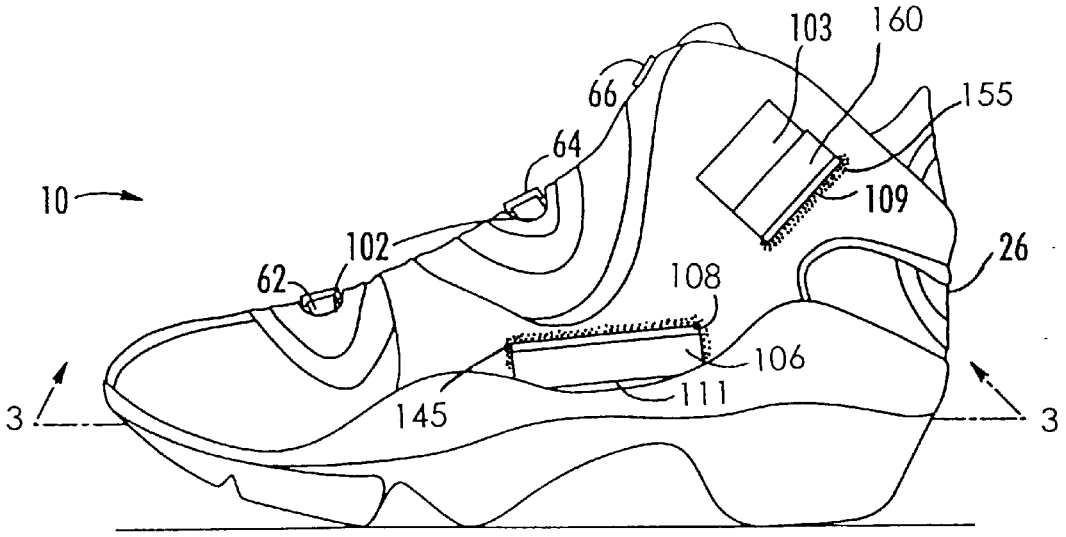
FIG. 1 is a side view of the inside edge of the right shoe of the present invention according to a preferred embodiment.
Figure 2:
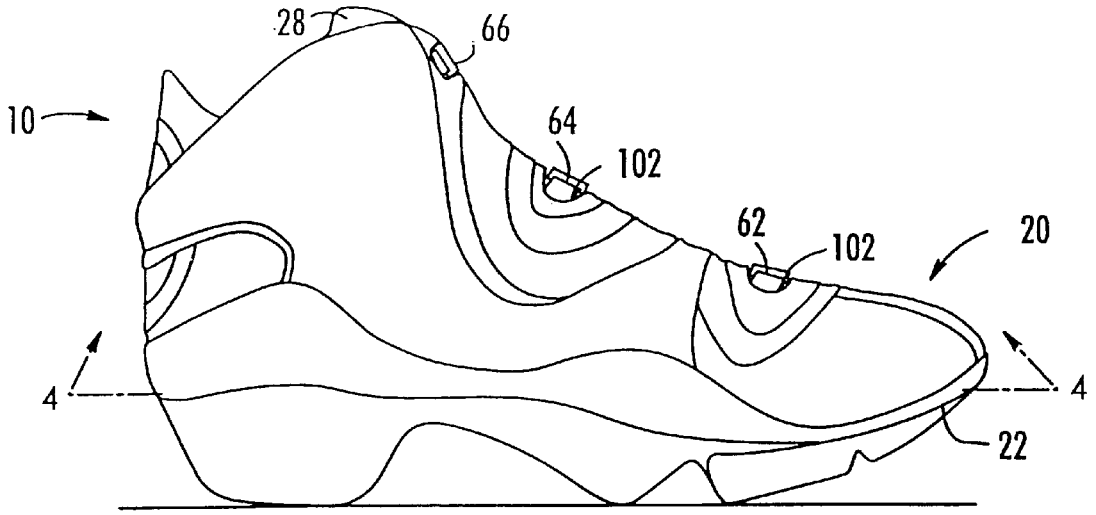
FIG. 2 is a side view of the outside edge of the right shoe of the present invention according to a preferred embodiment.
Figure 3:
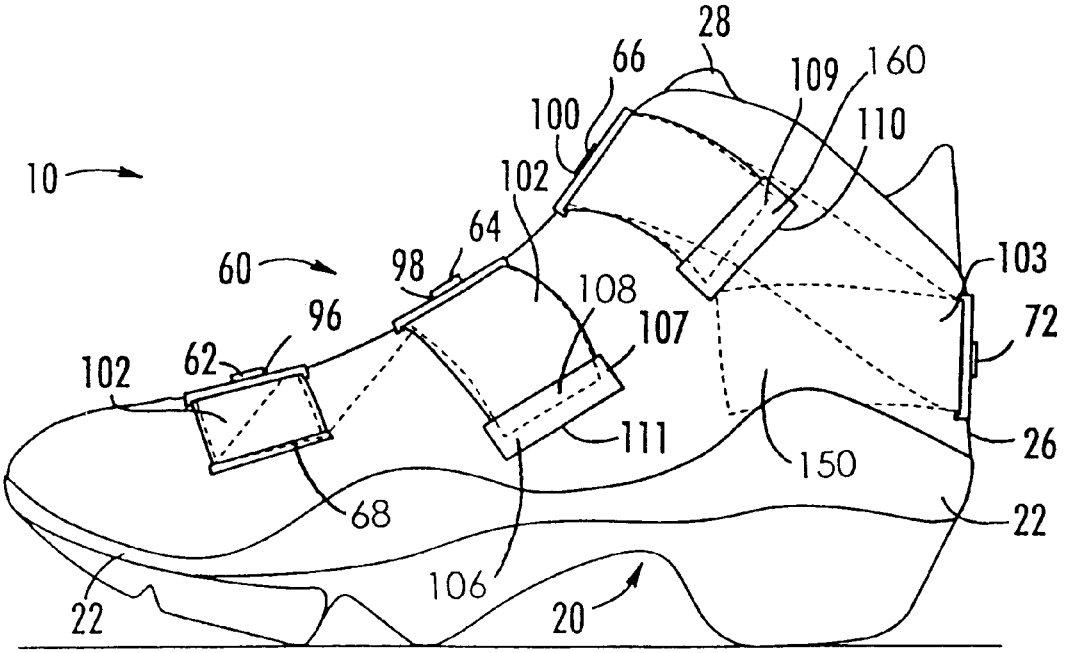
FIG. 3 is a sectional view along line 3—3 of FIG. 1 of the present invention according to a preferred embodiment.
Figure 4:
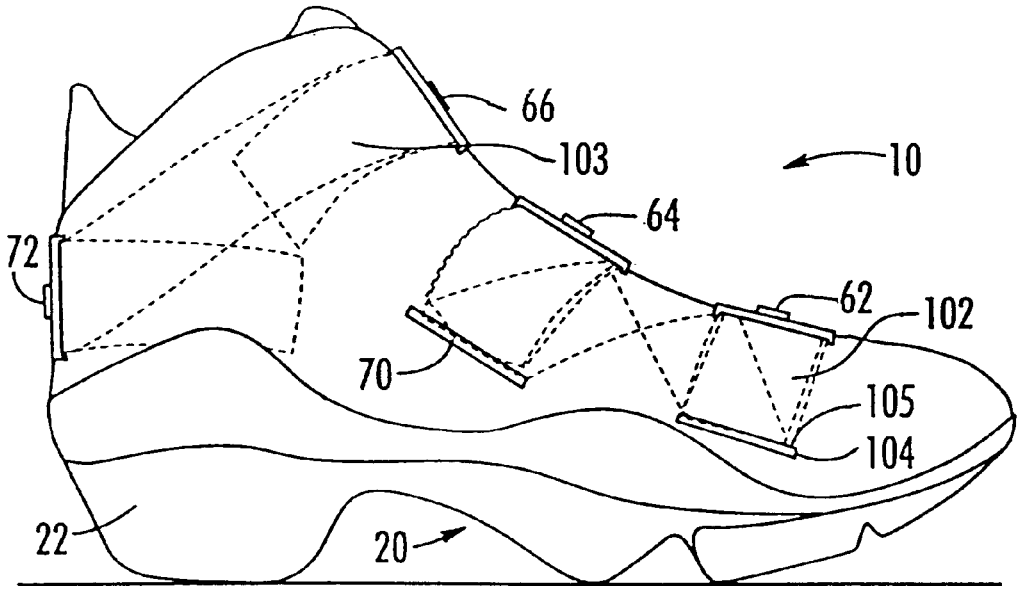
FIG. 4 is a sectional view along line 4—4 of FIG. 2 of the present invention according to a preferred embodiment.

Referring now to FIGS. 1–4, device 10 in a preferred embodiment generally comprises shoe 20, lacing guide system 60, first lace 102, second lace 103, first buckle 108 and second buckle 109. More particularly, lacing guide system 60 preferably comprises a plurality of lace guides 62, 64, 66, 68, 70, 72. Lace guides 62, 64, 66 are positioned generally near the top center of shoe 20 spaced apart along approximately a center line of tongue 28. Lace guide 68 is positioned generally on the inner side of shoe 20 under the exterior surface and proximal to sole 22. Lace guide 70 is positioned generally on the outer side of shoe 20 under the exterior surface and proximal to sole 22. An additional lace guide 72 is positioned generally near the center of heel 26. Lace guides 68, 70, 72 are internal and thus are not visible from the exterior of the shoe. Lace guides 62, 64, 66 protrude through apertures 96, 98, 100, respectively, formed through the exterior layer of shoe 20.

First lace 102 is generally an elongated rectangular-shaped elastic, cloth or other flexible material having first end 104 and second end 106. First end 104 of first lace 102 is fixably secured by sewing or other known means to the internal portion of the shell of shoe 20, preferably near the toe portion of shoe 20 at location 105. Second end 106 of first lace 102 is first channeled through lace guide 62 positioned on the upper center of shoe 20 and then down to and through lace guide 68. The above pattern is repeated until second end 106 of first lace 102 has been channeled through remaining lace guides 70 and 64, sequentially. Next, second end 106 of first lace 102 exits shoe 20 at opening 107 proximal to first buckle 108, wherein first buckle 108 is secured to the exterior of shoe 20 proximal to sole 22 on the inner side of shoe 20. First slit 111 is formed in close proximity to the exit side of first buckle 108 and is dimensioned for receiving second end 106 of first lace 102 and any excess lace. Alternatively or in addition to first buckle 108, hook-and-loop fastener 175 may be utilized to secure first lace 102 in position.

Second lace 103 is generally an elongated rectangular-shaped elastic, cloth or other flexible material having first end 150 and second end 160. First end 150 of second lace 103 is fixably secured by sewing or other known means to the internal portion of the shell of shoe 20, preferably on the inner side and proximal to heel 26 of shoe 20. Second end 160 internally wraps around heel 26, through lace guide 72 and around through lace guide 66. At lace guide 66, second end 160 of second lace 103 exits shoe 20 and becomes exterior. Second end 160 of second lace 103 is then channeled through and secured by second buckle 109, wherein buckle 109 is secured to the exterior of shoe 20 proximal to the secured location of first end 150 of second lace 103. To receive and secure second end 160 of lace 103 slit 110 is formed in close proximity to the exit side of second buckle 109 and is dimensioned for receiving second end 160 of second lace 103 and any excess lace. Alternatively or in addition to second buckle 109, hook-and-loop fastener 155 may be positioned in close proximity to the exit side of second buckle 109 to secure second lace 103 in position.

Figure 5:
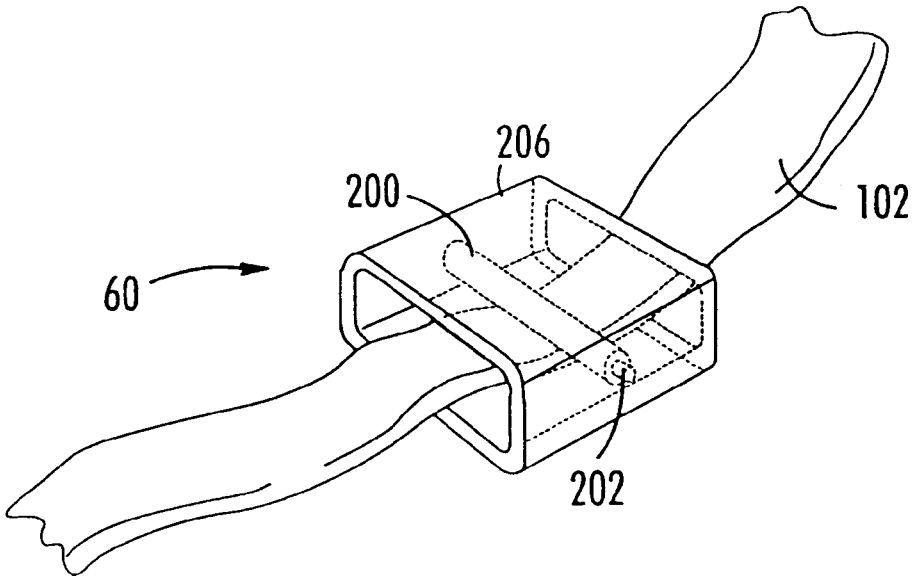
FIG. 5 is a perspective view of a lace guide according to a preferred embodiment.
Figure 6:
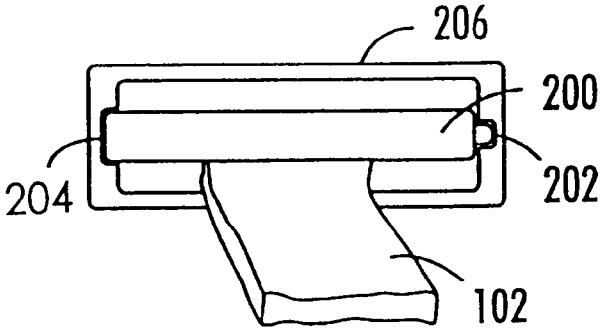
FIG. 6 is a sectional side view of a lace guide according to a preferred embodiment.

Now referring to FIGS. 5–6, each lace guide 6,64, 66, 68, 70, 72 comprises casing 206 and roller 200. Each roller 200 rotates about pin 202 which additionally serves to secure roller 200 within casing 206 by engaging an aperture or dimple within casing 206. Casing 206 is generally a four-sided rectangular box-like structure having two opposite opened ends. Each casing 206 is secured at the respective locations in shoe 20 by adhesive material, a securing strap extending through casing 206 and sewn to shoe 20, or by other known means. First lace 102 and second lace 103 extend through the opened ends and over or under roller 200. To allow first lace 102 to rotate about the respective rollers 200, first lace 102 is channeled over roller 200 in lace guides 62 and 64, and under roller 200 in lace guides 68 and 70. To allow second lace 103 to rotate about the respective rollers 200, second lace 103 is channeled over roller 200 in lace guides 66 and 72.

In use, because of the strategically placed lace guides 62, 64, 66, 68, 70, 72 a user simply pulls on the exposed second end 106 of first lace 102 and the second end 160 of second lace 103 thereby allowing the laces 102, 103 to roll along the respective rollers 200 positioned within each lace guide. Additionally, because the first ends 104, 150 of each lace 102, 103 are fixed, the pulling on the second ends 106, 160 of the laces 102, 103 will result in a reciprocating force about each lace guide 62, 64, 66, 68, 70, 72 thus tightening the shoe around the user's foot. Each lace 102, 103 may be pulled separately, allowing one-handed tightening of shoe 20.

The above detailed description of a preferred embodiment or alternated embodiments are for exemplary purposes only and are not meant to limit the scope or spirit of the invention as defined by the appended claims.

What is claimed is:

1. An internally laced shoe having a sole, an upper portion, a toe portion, a first side, a second side, and a heel portion, comprising:

a first lace having a first end and a second free end, said first end of said first lace secured within said shoe proximal to said toe portion, said second end of said lace extended substantially internally at least from said first side across said upper portion to said second side and from said second side across said upper portion to said first side, said second end of said lace extended to the exterior of said shoe;

a second lace having a first end and a second end, said first end of said second lace secured within said shoe, said second end of said second lace extended substantially internally at least around said heel portion, said second end of said second lace extended to the exterior of said shoe;

first lace guides carried by said shoe for slidably engaging and guiding said first lace;

second lace guides carried by said shoe for slidably engaging and guiding said second lace;

first lace securing means carried by said shoe for adjustably securing said second end of said first lace; and second lace securing means carried by said shoe for adjustably securing said second end of said second lace, wherein said second end of said first lace and said second end of said second lace are pullable by hand, and wherein when said second end of said first lace and said second end of said second lace are pulled, said first lace and said second lace slide about said first guides and said second lace guides, respectively, producing a reciprocating force about said first lace guides and said second lace guides and thus, tightening said shoe around a foot.

2. The device of claim 1, wherein said first lace guides are a plurality of members each having an aperture therethrough for receiving said first lace, and a roller rotatably engaged within each of said members, wherein said first lace engages said roller and slides about said roller when said first lace moves.

3. The device of claim 1, wherein said second lace guides are a plurality of members each having an aperture therethrough for receiving said second lace, and a roller rotatably engaged within each of said members, wherein said second lace engages said roller and slides about said roller when said second lace moves.

4. The device of claim 1, wherein said first lace securing means and said second lace securing means is a buckle.

5. The device of claim 1, wherein said first lace securing means and said second lace securing means is hook and loop fastener.

6. The device of claim 1, wherein at least one of said second lace guide means is positioned at the heel of said shoe.

7. An internally laced shoe having a sole, an upper portion, a toe portion, a first side, a second side, and a heel portion, comprising:

a first lace having a first end and a second free end, said first end of said first lace secured within said shoe proximal to said toe portion, said second end of said lace extended substantially internally at least from said first side across said upper portion to said second side and from said second side across said upper portion to said first side, said second end of said lace extended to the exterior of said shoe;

a second lace having a first end and a second end, said first end of said second lace secured within said shoe, said second end of said second lace extended substantially internally at least around said heel portion, said second end of said second lace extended to the exterior of said shoe;

a plurality of first lace guides carried by said shoe, said plurality of first lace guides comprising a plurality of members each having an aperture therethrough for receiving said first lace, and a roller rotatably engaged within each of said members, wherein said second lace engages said roller and slides about said roller when said second lace moves;

a plurality of second lace guides carried by said shoe, said plurality of second lace guides comprising a plurality of members each having an aperture therethrough for receiving said first lace, and a roller rotatably engaged within each of said members, wherein said second lace engages said roller and slides about said roller when said second lace moves;

first lace securing means carried by said shoe for adjustably securing said second end of said first lace; and second lace securing means carried by said shoe for adjustably securing said second end of said second lace, wherein said second end of said first lace and said second end of said second lace are pullable by hand, and wherein when said second end of said first lace and said second end of said second lace are pulled, said first lace and said second lace slide about said first guides and said second lace guides, respectively, producing a reciprocating force about said first lace guides and said second lace guides and thus, tightening said shoe around a foot.

8. The device of claim 7, wherein said first lace securing means and said second lace securing means is a buckle.

9. The device of claim 7, said first lace securing means and said second lace securing means is hook and loop fastener.

10. The device of claim 7, wherein at least one of said plurality of second lace guides is positioned at the heel of said shoe.

* * * * *